US009484695B2

(12) United States Patent
Puschnigg et al.

(10) Patent No.: US 9,484,695 B2
(45) Date of Patent: Nov. 1, 2016

(54) SMART PLUG SYSTEM AND METHOD

(71) Applicant: BOSS CONTROLS, LLC, Ligonier, PA (US)

(72) Inventors: Greg W. Puschnigg, Ligonier, PA (US); Mike Krummey, Harrison City, PA (US)

(73) Assignee: Boss Controls, LLC, Pittsburgh, PA (US)

( * ) Notice: Subject to any disclaimer, the term of this patent is extended or adjusted under 35 U.S.C. 154(b) by 0 days.

(21) Appl. No.: 14/622,903

(22) Filed: Feb. 15, 2015

(65) Prior Publication Data

US 2015/0236449 A1 Aug. 20, 2015

Related U.S. Application Data

(60) Provisional application No. 61/940,307, filed on Feb. 14, 2014.

(51) Int. Cl.

| | |
|---|---|
| ***H01R 13/62*** | (2006.01) |
| ***H01R 31/06*** | (2006.01) |
| ***H01R 13/639*** | (2006.01) |
| *H01R 13/717* | (2006.01) |
| *H01R 13/46* | (2006.01) |

(52) U.S. Cl.

CPC ..... *H01R 31/065* (2013.01); *H01R 13/6397* (2013.01); *H01R 13/465* (2013.01); *H01R 13/717* (2013.01); *Y10T 29/49117* (2015.01)

(58) Field of Classification Search

CPC ..... H01R 31/065; H01R 13/6397; H01R 13/447; H01R 13/695; H01R 13/645; H01R 13/717; Y10T 29/49117

USPC ..... 439/304

See application file for complete search history.

(56) References Cited

U.S. PATENT DOCUMENTS

| | | | | |
|---|---|---|---|---|
| 4,669,281 | A * | 6/1987 | Young | E05B 73/0005 439/133 |
| 5,108,297 | A * | 4/1992 | Hoffman | H01R 13/447 439/134 |
| 6,049,045 | A * | 4/2000 | Becker | H01R 31/06 200/43.08 |
| 6,196,857 | B1 * | 3/2001 | Fong | H01R 13/6397 439/304 |
| 6,389,853 | B1 * | 5/2002 | Pate | E05B 45/005 340/432 |
| 6,522,532 | B2 * | 2/2003 | Liao | G06F 1/1632 312/223.1 |
| 6,811,415 | B2 * | 11/2004 | Chen | H01R 13/6397 439/133 |
| 7,101,201 | B1 * | 9/2006 | McCollum | H01R 13/6397 439/133 |
| 7,275,941 | B1 * | 10/2007 | Bushby | H01R 13/6397 439/133 |
| 8,613,629 | B2 * | 12/2013 | Gong | H01R 13/6395 439/371 |
| 9,103,142 | B2 * | 8/2015 | Abdollahzadeh | E05B 15/1607 |
| 9,197,018 | B2 * | 11/2015 | Garofalo | H01R 13/6395 |
| 2015/0325940 | A1 * | 11/2015 | Foseide | G06F 21/88 439/304 |

* cited by examiner

*Primary Examiner* — Jean F Duverne
(74) *Attorney, Agent, or Firm* — Spilman Thomas & Battle, PLLC; Eric D. Ruka

(57) ABSTRACT

A smart plug system includes, in an embodiment, a smart plug that may be securable to an electrical outlet by way of an anti-theft device. The anti-theft device may include in an embodiment: a body securable to the electrical outlet; and a protrusion that extends from the body and which may extend into an aperture of the smart plug to secure the smart plug to the electrical outlet when the smart plug is plugged into an electrical outlet. In an embodiment, the smart plug may be configured to be customizable in appearance by including a plurality of different covers that may be secured to a face of the smart plug.

6 Claims, 8 Drawing Sheets

SMART PLUG SYSTEM AND METHOD

CROSS REFERENCE TO RELATED APPLICATION

This application claims priority to U.S. provisional patent application No. 61/940,307,filed Feb. 14, 2014,which is incorporated herein in by reference in its entirety.

FIELD OF THE INVENTION

The invention relates to a smart plug system and method, and more particularly to a smart plug system and method including an anti-theft device for a smart plug. The invention also relates to a smart plug that is customizable.

BACKGROUND OF THE INVENTION

A smart plug is an electronic device that may be configured to plug into an electrical outlet and allow devices to be plugged into it. Through the smart plug, the power from the outlet to those devices may be remotely controlled, such as by a cell phone or other mobile device, personal computer, or other wireless or wired controller. Thus, a user may remotely turn on or off devices, schedule power to those devices, and monitor their energy use.

However, smart plugs may be prone to easy theft, as stealing a smart plug may be as simple as unplugging it from the outlet and removing any devices plugged therein. There may thus be a need for a device that deters or prevents a smart plug from being removed from the outlet or prevents an appliance or other apparatus from being unplugged from the smart plug.

Additionally, there may be a need for a smart plug that may be customizable such that it may be configured to take on different appearances.

Further, there may be a need for a smart plug that allows for various features to be substituted, such as the aforementioned.

SUMMARY OF THE INVENTION

In an embodiment, a smart plug system includes: a smart plug; and an anti-theft device comprising a body and a fastener, the body to secure the smart plug to the electrical outlet by way of the fastener when the smart plug is plugged into the electrical outlet.

In another embodiment, a smart plug system includes: a smart plug; and an anti-theft device secured to the smart plug, the anti-theft device comprising: a body; a tether secured to the body, the tether comprising a loop; and a fastener to secure the body of the anti-theft device, and thereby the smart plug, to the electrical outlet by extending through the loop of the tether and into the electrical outlet.

In another embodiment, a smart plug system includes: a smart plug; and an anti-theft device comprising a clamp securable to the smart plug, the clamp comprising a securing structure, the securing structure to be secured to at least one of a plug and a cord of an apparatus to restrict removal of the apparatus plug from the smart plug.

In another embodiment, a smart plug method includes: plugging a smart plug into an electrical outlet; securing, using an anti-theft device, at least one of: the smart plug to the electrical outlet; and an apparatus to the smart plug; the securing thereby qualifying the smart plug as a permanent installation; and receiving a utility rebate based on the qualification of the smart plug as the permanent installation.

In another embodiment, a smart plug method includes: plugging a smart plug that comprises an aperture into an electrical outlet; extending a protrusion of an anti-theft device at least partially into the aperture of the smart plug; extending a fastener through a hole in the anti-theft device and further into an electrical outlet hole of the electrical outlet to secure the smart plug to the electrical outlet to thereby qualify the smart plug as a permanent installation; and receiving a utility rebate based on the qualification of the smart plug as the permanent installation.

Other embodiments, which may include one or more parts of the aforementioned systems and methods or other parts, are also contemplated, and may thus have a broader or different scope than the aforementioned systems and methods. Thus, the embodiments in this Summary of the Invention are mere examples, and are not intended to limit or define the scope of the invention or claims.

BRIEF DESCRIPTION OF THE DRAWINGS

The accompanying drawings, wherein like reference numerals are employed to designate like components, are included to provide a further understanding of smart plug systems and methods is incorporated in and constitutes a part of this specification, and illustrates embodiments of smart plug systems and methods therefore that together with the description serve to explain the principles of smart plug systems and methods therefore.

Various other objects, features and advantages of the invention will be readily apparent according to the following description exemplified by the drawings, which are shown by way of example only, wherein.

DETAILED DESCRIPTION

Reference will now be made to embodiments of smart plug systems and methods, examples of which are illustrated in the accompanying drawings. Details, features, and advantages of smart plug systems and methods therefore will become further apparent in the following detailed description of embodiments thereof.

It is to be understood that the specific systems, methods, and apparatuses described in the following specification are simply exemplary embodiments of the present invention and are not to be considered as limiting.

Any reference in the specification to "one embodiment," "a certain embodiment," or a similar reference to an embodiment is intended to indicate that a particular feature, structure or characteristic described in connection with the embodiment is included in at least one embodiment of the invention. The appearances of such terms in various places in the specification do not necessarily all refer to the same embodiment. References to "or" are furthermore intended as inclusive, so "or" may indicate one or another of the ored terms or more than one ored term.

As described herein, embodiments of the smart plug systems and methods provide a smart plug that can add accessories such as anti-theft devices and replaceable faceplate covers that each have one or more differences including décor.

Figure 1:
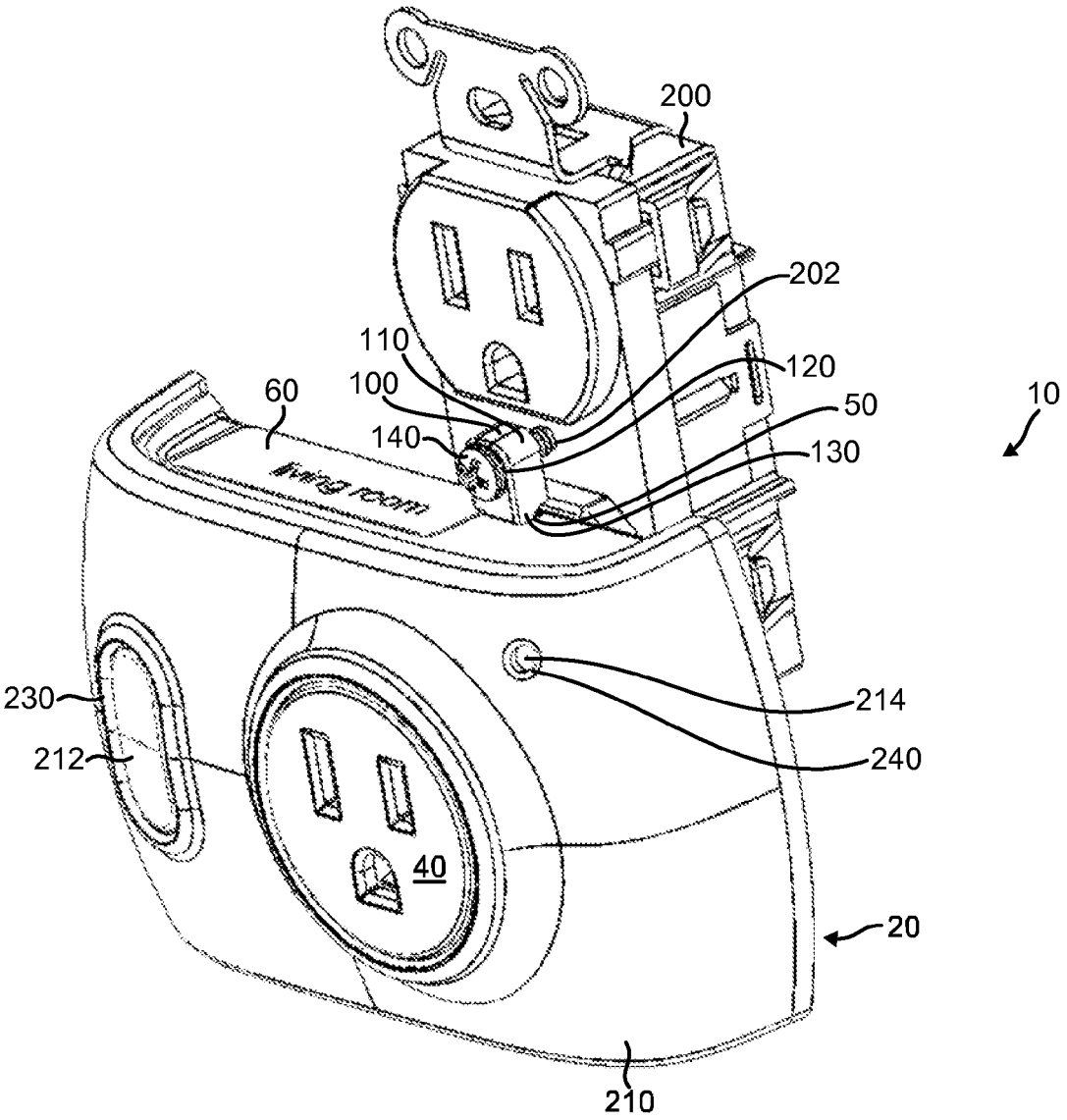
FIG. 1 illustrates a perspective view of a smart plug system including an anti-theft device, in accordance with an embodiment.
Figure 2:
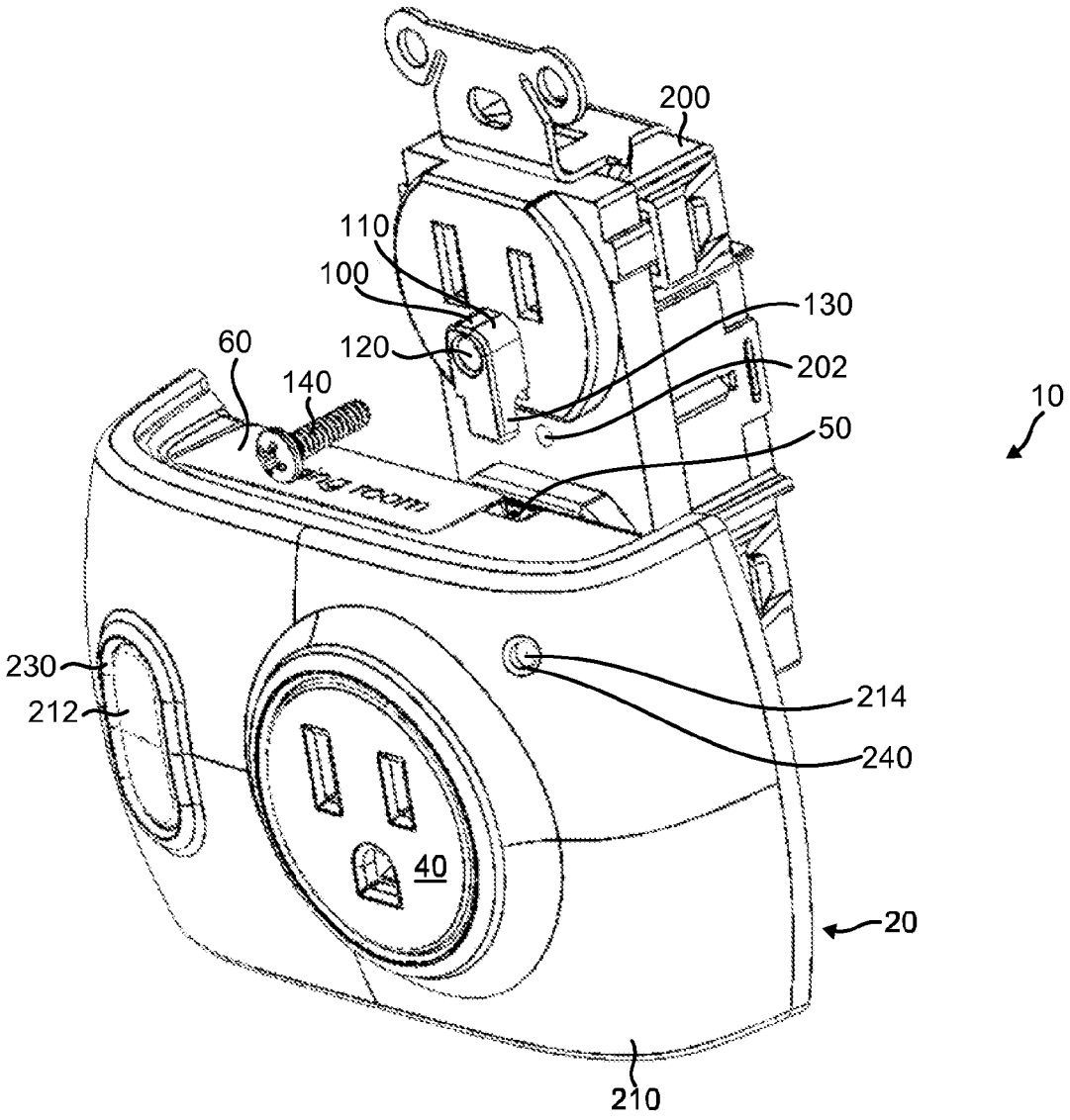
FIG. 2 illustrates a perspective view of a smart plug system including an anti-theft device, in accordance with one embodiment.
Figure 3:
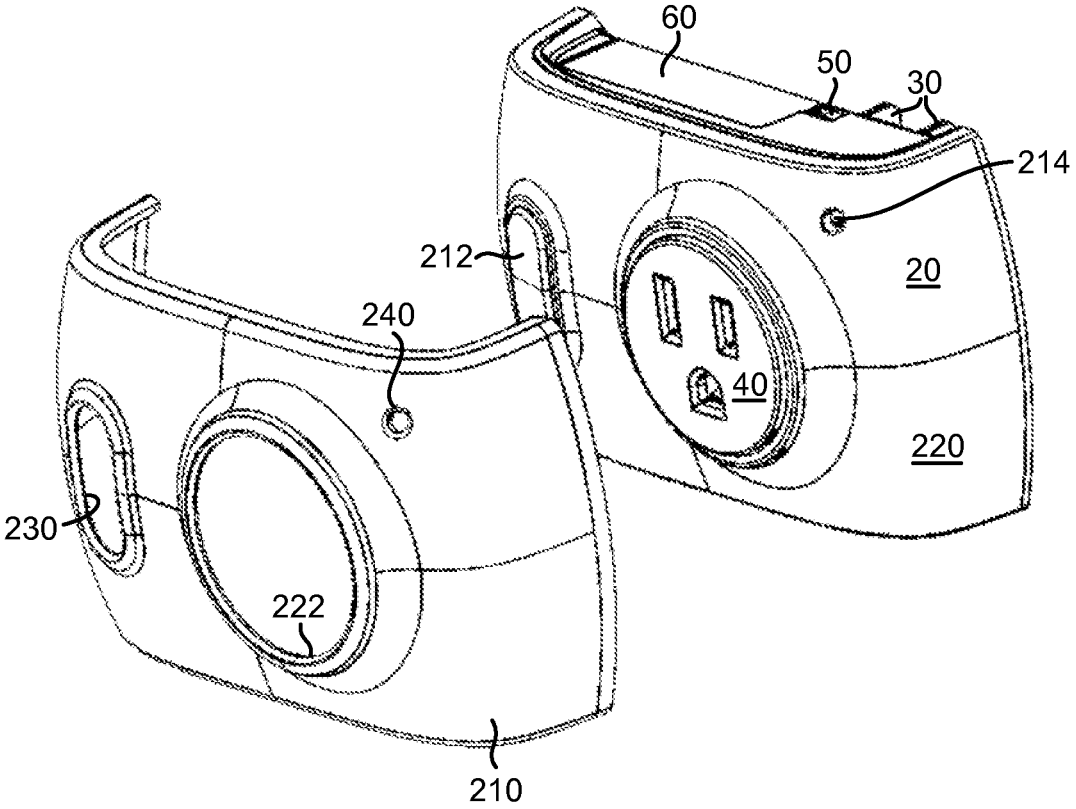
FIG. 3 illustrates a perspective view of a smart plug with attachable cover, in accordance with an embodiment.

FIG. 1 illustrates a perspective view of a smart plug system 10, in accordance with one embodiment. The system 10 may include a smart plug 20 and an anti-theft device 100. In FIG. 1, the system 10 is in the secured position such that the smart plug 20 is secured to an outlet 200 by way of the anti-theft device 100, as described below. FIG. 2 illustrates the anti-theft device 100 not in the secured position, and thus not with the anti-theft device 100 securing the smart plug 20 to an electrical outlet 200. FIG. 3 illustrates another perspective view of the smart plug 20 with its replaceable cover 210 unattached, in accordance with one embodiment.

Referring to FIGS. 1 through 3, the smart plug 20 may include two or three prongs (two prongs 30 of which can be seen in FIG. 3) that allow the smart plug 20 to be plugged into an electrical outlet 200. The smart plug 20 may also include a plug receptacle 40, which may include two or three holes, for example, for a two or three pronged plug of an electrical device (electrical device not shown) to plug into to connect the electrical device to the electrical outlet 200 via the smart plug 20. When an electrical device is plugged into a smart plug 20 that is plugged into an electrical outlet 200, the power to that electrical device may be remotely controlled by a wireless or wired controller.

In one embodiment, the smart plug 20 includes an aperture 50 therein to receive a protrusion 130 of the anti-theft device 100 for securing the anti-theft device 100 to the smart plug 20 as described below. In an embodiment, the aperture 50 is in a side 60 of the smart plug 20, though the aperture 50 may be otherwise positioned within the smart plug 20 as desired. The side 60 may be adjacent to the face 220, which is discussed herein and shown in FIG. 3. The securing mechanism can be configured otherwise as desired.

The anti-theft device 100 may be separate from and detachable from the smart plug 20. The anti-theft device 100 may comprise a body 110 having a hole 120 (hole 120 best seen in FIG. 2) extending therethrough, a protrusion 130 that extends from the body 110, and a fastener 140. The body 110 and protrusion 130 may be made of any desired material, such as a hard plastic that is strong enough to be difficult to manually crack or break. The body 110 may be shaped and sized as desired, such as partially cylindrical with the hole 120 extending through the axis of the cylindrical portion, or may be another shape. In an embodiment, the hole 120 is threaded for receiving a fastener 140 that is a screw. The protrusion 130 may also be shaped as desired. For example, the protrusion 130 may be an elongated or other-shaped portion and may be unitary with the body 110. The fastener 140 may be tamper-resistant in an embodiment, as described below.

The body 110 of the anti-theft device 110 may secure the smart plug 20 to the electrical outlet 200 by way of the fastener 140. In an embodiment, in securing the smart plug 20 to the electrical outlet 200, the protrusion 130 of the anti-theft device 100 may be extended at least partially into the aperture 50 of the smart plug 20. The fastener 140 may then be screwed or otherwise extended through the hole 120 of the body 110 of the anti-theft device 100 and into the electrical outlet 200, such as into a threaded or other hole 202 of the electrical outlet 200, to secure the fastener 140, and thus the anti-theft device 100, to the outlet 200. As so secured, the protrusion 130 of the anti-theft device 100 may extend at least partially in the aperture 50 of the smart plug 20, such as shown in FIG. 1. In that position, the smart plug 20 may be secured to the outlet 200 by way of the fastener 140 because the protrusion 130 of the anti-theft device 100 is secured in place and blocking the removal of the smart plug 20 from the electrical outlet 200.

The extension of the protrusion 130 into the aperture 50 of the smart plug 20 may be adjustable. For example, the protrusion 130 may extend from a small portion to fully into the aperture 50 to align the hole 120 of the body with the hole 202 of the electrical outlet 200. When the holes 120 and 202 are aligned, the fastener 140 may extend through both of those holes.

Figure 4:
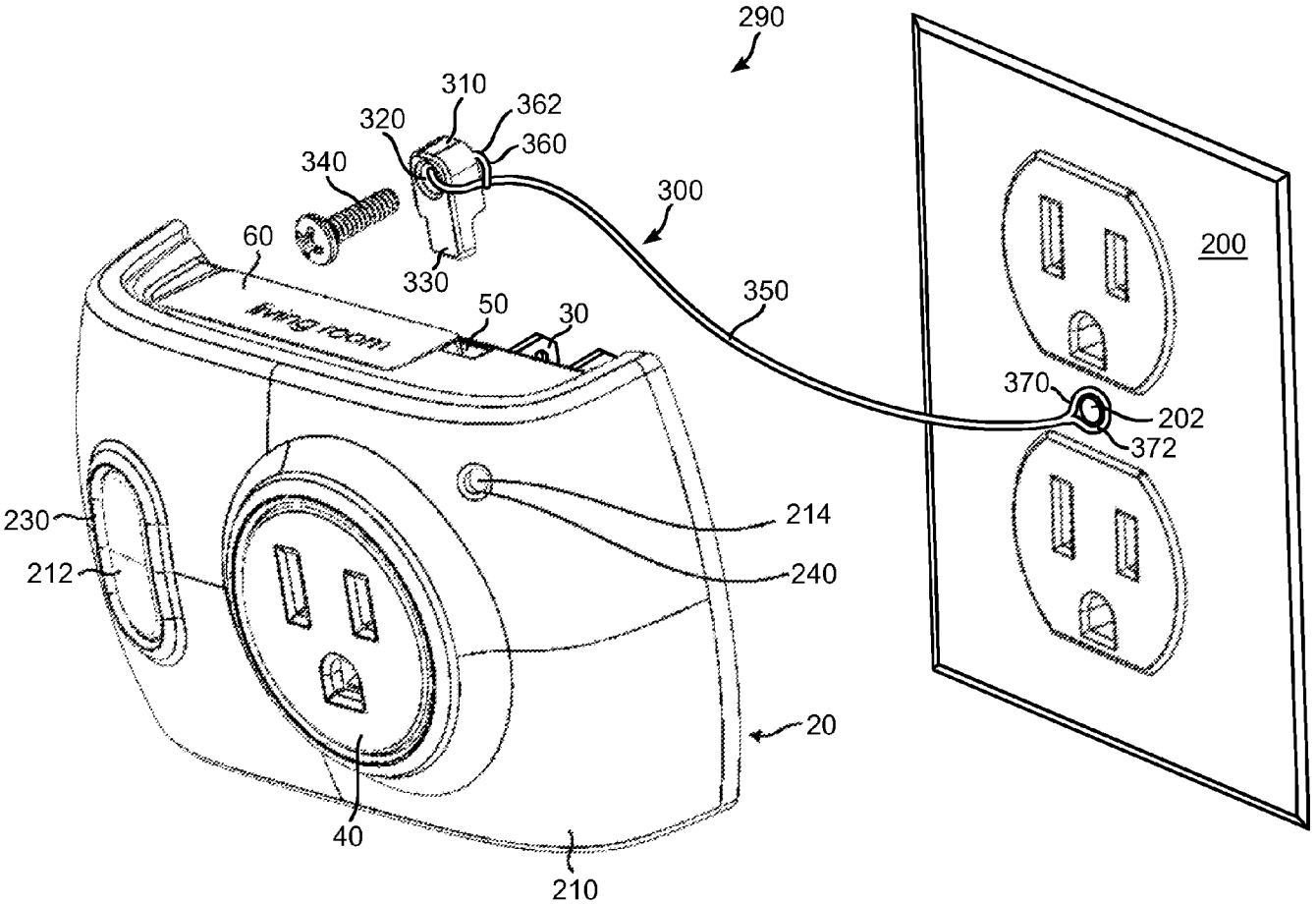
FIG. 4 illustrates a perspective view of a smart plug system including an anti-theft device, in accordance with one embodiment.
Figure 5:
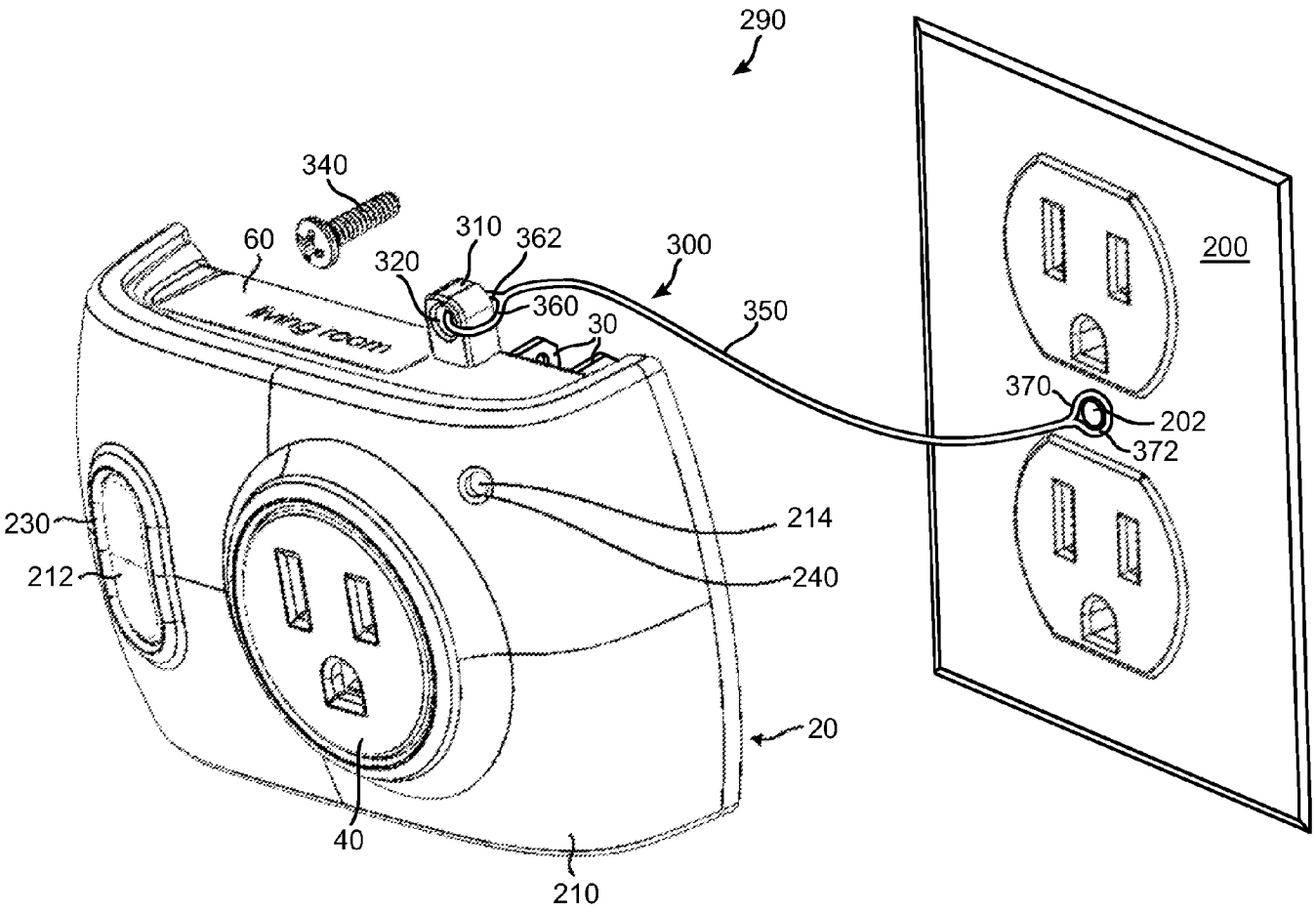
FIG. 5 illustrates a perspective view of a smart plug system including an anti-theft device, in accordance with one embodiment.

In other embodiments, the mechanism for securing the smart plug 20 to the outlet 200 may be otherwise configured. For example, FIG. 4 illustrates a perspective view of an embodiment of a smart plug system 290 in which an anti-theft device 300 includes a tether 350, which may be a rope, chain, wire, or other elongated piece secured to the body 310. In this embodiment, elements 310, 320, 330, and 340 of the anti-theft device 300 correspond to elements 110, 120, 130, and 140 of the anti-theft device 100 as described herein. The anti-theft device 300 may be secured to the smart plug 20 by having its body 310 and protrusion 330 secured to the smart plug 20. For example, the body 310 and protrusion 330 of the anti-theft device 300 may be integral with the smart plug 20, such as by being formed with the smart plug 20, or otherwise secured thereto, such as by screw or other fastener or otherwise, or via the same method as described above with respect to the anti-theft device 100 (plugging the smart plug 20 into the outlet 200 and securing the body 310 of the anti-theft device 100 to the smart plug 20 via securing the body 310 to the outlet 200 with the fastener 440). If the anti-theft device 300 is integral with the smart plug 20, in an embodiment, the anti-theft device 300 may not include a protrusion 330 and the smart plug 20 may not include an aperture 50, as the anti-theft device 300 body 310 may be formed with the smart plug 20, such as shown in FIG. 5. In the embodiment shown in FIG. 5, the fastener 340 may not extend through the hole 320 of the body 310 but may extend directly into the hole 202 of the outlet 200. In that embodiment, the body 310 and its hole 320 may not be aligned with the outlet 200 hole 202 in the embodiment in FIG. 5 when the smart plug 20 is plugged into the outlet 200.

The tether 350 may include a first loop 360, such as at a first end 362 of the tether 350. The first loop 360 may extend through the hole 320 of the anti-theft device 300 body 310 to secure the tether 350 (and thus the anti-theft device 300) to the body 310.

The tether 350 may then be secured to the outlet 200 via the hole 202 as desired. For example, in an embodiment, the tether 350 may include at its second end 372 a second loop 370 through which the fastener 340 may extend. The fastener 340 may further extend into the hole 202 to secure the tether 350 to the outlet 200. In this embodiment, the loop 370 may have a diameter or width that is greater than the threading or shaft of the fastener 340 and less than the diameter of the head of the fastener 340. In this embodiment, the fastener 340 may not extend through the hole 320 of the anti-theft device 300 body 310, but may do so in other embodiments.

Figure 6:
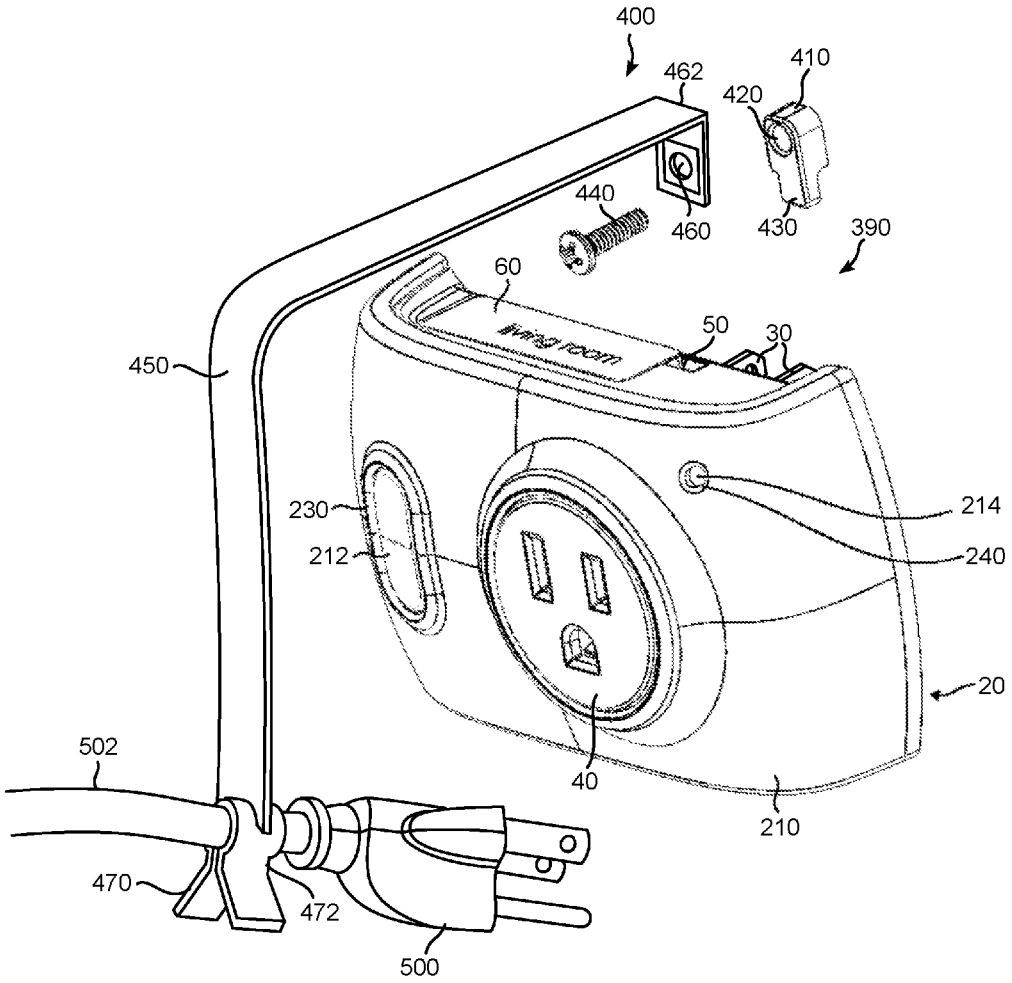
FIG. 6 illustrates a perspective view of a smart plug system including an anti-theft device, in accordance with one embodiment.

FIG. 6 illustrates a perspective view of a smart plug system 390 in which an anti-theft device 400 includes a clamp 450 securable to the smart plug 20 and for securing the smart plug 20 to at least one of a plug and a cord, such as plug 500 and cord 502, of an apparatus such as an appliance (apparatus not shown). In this embodiment, elements 410, 420, 430, and 440 of the anti-theft device 400 correspond to elements 110, 120, 130, and 140 of the anti-theft device 100 as described herein. In this embodiment, the clamp 450 may be a rope, chain, wire, or other piece, which may be elongated, having a hole 460 and a securing structure 470. The hole 460 may be at one end 462 of the clamp 450 and the securing structure 470 may be at the other end 472, if desired. The hole 460 may align with the hole 420 of the body 410 of the anti-theft device 400 such that the fastener 440 may extend through body hole 420 and clamp hole 460 and into the hole 202 of the outlet 200 to secure the anti-theft device 400 to the outlet 200 (and secure the clamp 450 and body 410, and thus the anti-theft device 400, to the smart plug 20). The securing structure 470 of the clamp 450 may be a structure that is secured to the rest of the clamp 450 and may be secured to the plug 500, cord 502, or both the plug 500 and cord 502. For example, the securing structure 470 may be a cord clip or clamp secured to the rest of the clamp 450 and which may be secured to the cord 502 and/or plug 500, such as by being tightened around the cord 502 and/or plug 500, to restrict removal of the plug 500 from the smart plug 20. The clamp 450 may restrict removal of the plug 500 by restricting the unplugging of the plug 500 from the plug receptacle 40 of the smart plug 20 or by restricting the plug 500 from being unsecured from the smart plug 20. The clamp 450 may restrict the plug 500 from being unsecured from the smart plug 20 if the plug 500 may be partially or fully unplugged from the plug receptacle 40 of the smart plug 20, but is still secured to the smart plug 20 by being secured to the clamp 450 by way of the securing structure 470. If desired, the clamp 450 may be designed with a desired material and size to render the clamp 450 short and/or rigid enough to restrict the removal of the plug 500 from the plug receptacle 40 of the smart plug 20 when the securing structure 470 is secured to the cord 502 and/or plug 500 of the apparatus. Thus, the anti-theft device 400 may secure the smart plug 20 to both the outlet 200 and the plug 500 and/or cord 502 (and thus the appliance or other apparatus attached to the plug 500 and cord 502).

Figure 7:
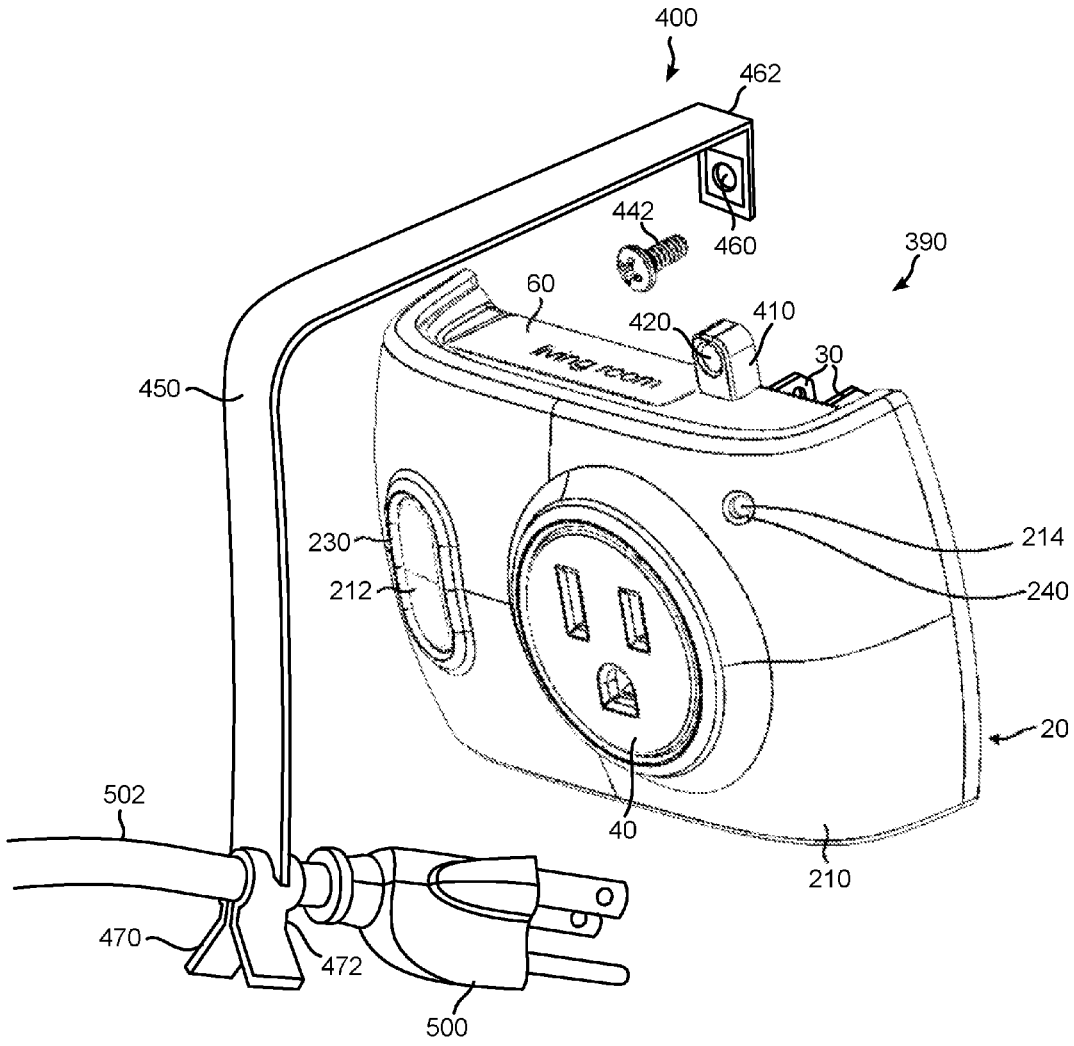
FIG. 7 illustrates a perspective view of a smart plug system including an anti-theft device, in accordance with one embodiment.

In an embodiment, the hole 460 of the clamp 450 may align with the hole 420 of the body 410 of the anti-theft device 400 such that the fastener 440 may extend through body holes 460 and 420 to secure the body 410 and clamp 450 together. In this embodiment, the fastener 440 may not further extend into the hole 202 of the outlet 200 such that the plug 500 (and thus the appliance or other apparatus attached to the plug 500) is secured to the smart plug 20, but the smart plug 20 is not secured to the outlet 200. For example, a shorter fastener 442, such as shown in FIG. 7, may be used in this embodiment such that the fastener 442 may not extend beyond the holes 420 and 460, such as shown in FIG. 7. In this embodiment, the body 410 may be secured to the smart plug 20, such as by being integral with or otherwise secured thereto, such as by screw or other fastener or otherwise. The body 410 may be integral with the smart plug 20 by being formed with the smart plug 20. If the anti-theft device 400 is integral with the smart plug 20, in an embodiment, the anti-theft device 400 may not include a protrusion 430 and the smart plug 20 may not include an aperture 50, as the anti-theft device 400 body 410 may be formed with the smart plug 20, such as shown in FIG. 7. In the embodiment of FIG. 7, the anti-theft device 400, and thus the clamp 450, may be secured to the smart plug 20 by the clamp 450 being secured to the body 410 with the fastener 440.

In an embodiment, the use of an anti-theft device, such as anti-theft device 100, 300, or 400, as a device that is at least partially separate from and may be detachable from the smart plug 20, or at least does not damage the smart plug 20 by its use, and secures the smart plug 20 to the electrical outlet 200 and/or the plug (e.g., plug 500) of an electrical device to the smart plug 20, may qualify the smart plug 20 as a permanent installation. Conversely, a device that damages a smart plug when installed, such as a nail or screw that is drilled through the smart plug and into the outlet or wall, may not qualify the smart plug as a permanent installation. As a permanent installation that promotes energy efficiency, the smart plug 20 secured to the electrical outlet 200 and/or the plug (e.g., plug 500) of an electrical device using the anti-theft device 100, 300, or 400 as described herein may qualify for utility rebates through governmental rebate programs.

The invention herein may include a method comprising using one of the anti-theft devices 100, 300, or 400 or another enclosed anti-theft device embodiment to secure the smart plug 20 to an outlet 200 and/or secure a plug (e.g., plug 500) of an electrical appliance or other apparatus to the smart plug 20 to qualify the smart plug 20 as a permanent installation. The method may further include receiving utility rebates through governmental rebate programs based on qualification of the smart plug 20 as a permanent installation.

Figure 8:
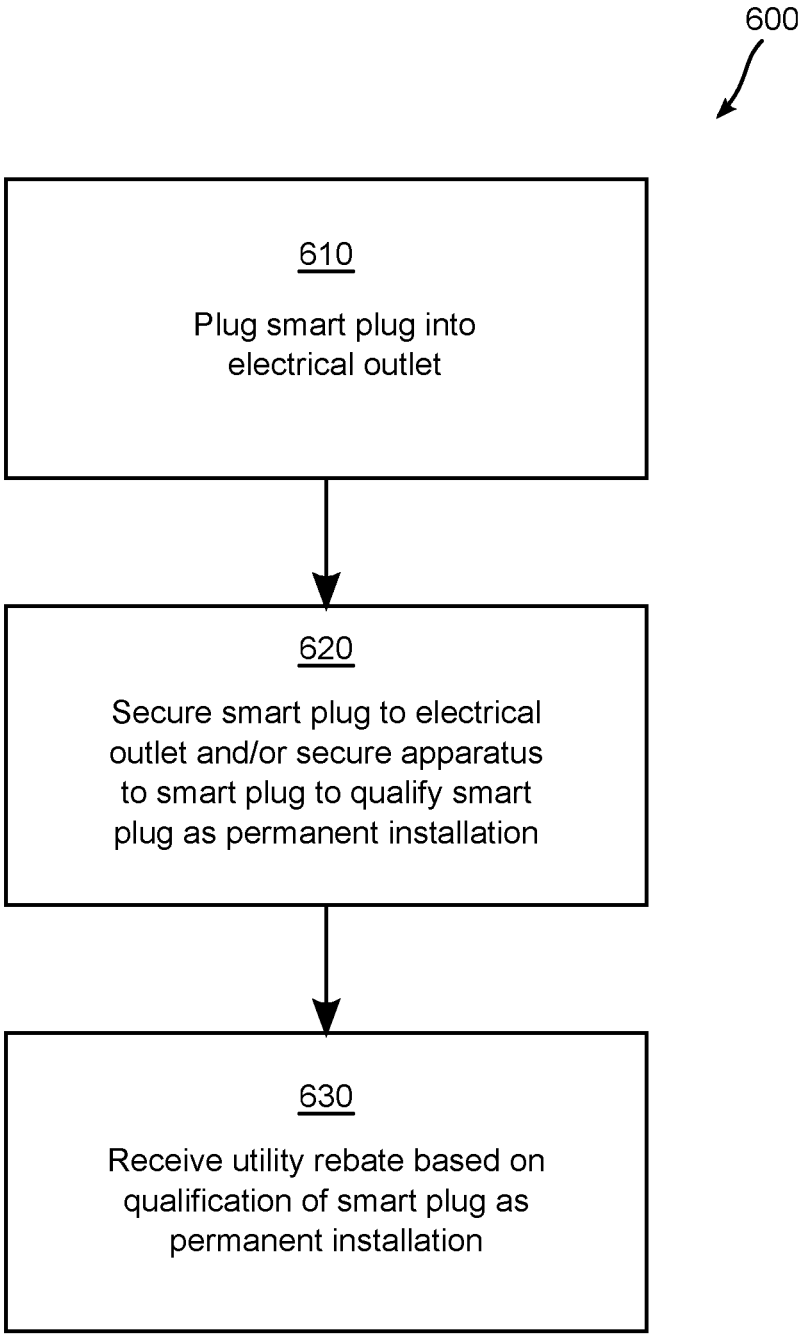
FIG. 8 is a flow chart of a smart plug method, in accordance with one embodiment.

For example, an embodiment of a smart plug method 600 is discussed with reference to the flow chart of FIG. 8 and employs one of the smart plug systems 10, 290, or 390 of FIGS. 1-7. The smart plug method 600 includes, at 610, plugging a smart plug 20 into an electrical outlet 200.

At 620, an anti-theft device (100, 300, 400) secures the smart plug 20 to the electrical outlet 200 and/or secures the apparatus via its plug 500 and/or cord 502 to the smart plug 20. For example, use of the anti-theft device 100 or 300 at 620 would secure the smart plug 20 to the electrical outlet 200. Depending on the embodiment, use of the anti-theft device 400 would secure the apparatus via its plug 500 and/or cord 502 to the smart plug 20 and possibly also secure the smart plug 20 to the electrical outlet 200. The anti-theft device 400 would secure the apparatus to the smart plug 20 if the fastener 440 extended through the hole 420 of the anti-theft device 400 body 410 (the body 410 being secured to the smart plug 20) and also through the hole 460 of the clamp 450 (but not necessarily further into the electrical outlet 200 hole 202). The anti-theft device 400 would secure the apparatus to the smart plug 20 and also secure the smart plug 20 to the outlet 200 if the fastener 440 of the anti-theft device 390 extended through the hole 420 of the body 410 and the hole 460 of the clamp 450 and also extended further into the electrical outlet 200 hole 202.

Further at 620, the aforementioned methods of securing qualify the smart plug 20 as a permanent installation.

At 630, a user of the smart plug method 600 receives a utility rebate, such as through a governmental rebate program, based on the qualification of the smart plug as a permanent installation.

In one embodiment of the smart plug method 600, the securing at 620, using the anti-theft device, of the smart plug 20 to the electrical outlet 200 includes extending a protrusion 130 of the anti-theft device 100 at least partially into the aperture 50 of the smart plug 20, and extending the fastener 140 through a hole 120 of the body 110 of the anti-theft device 100 and further into an electrical outlet hole 202 to secure the smart plug 20 to the electrical outlet 200.

In another embodiment of the smart plug method 600, the smart plug method 600, at 610, comprises plugging a smart plug 20 that comprises an aperture 50 into an electrical outlet 200. At 620 in that embodiment, the protrusion 130 of the anti-theft device 100 is extended at least partially into the aperture 50 of the smart plug 20. The fastener 140 is extended through the hole 120 of the body 110 of the anti-theft device 100 and further into the electrical outlet 200 hole 202 to secure the smart plug 20 to the electrical outlet 200. As so secured, the smart plug 20 may qualify as a permanent installation. At 630, the user of the smart plug method 600 may receive a utility rebate based on the qualification of the smart plug 20 as the permanent installation.

In another embodiment, the smart plug 20 may be customizable. For example, a smart plug 20 system may include the smart plug 20 and multiple covers 210 that may be secured against the smart plug 20. For example, in an embodiment as shown in FIG. 3, each cover 210 may be shaped to fit over the smart plug 20, such as against the smart plug 20 curved face 220 that includes the plug receptacle 40. In that embodiment, the cover 210 may be similarly curved and may include a plug receptacle hole 222 extending therethrough. The plug receptacle hole 222 may fit over and align with the plug receptacle 40 such that the plug receptacle 40 remains partially or fully exposed. The cover 210 may include one or more other holes 230 and 240 extending therethrough if desired to leave exposed other portions that embodiments of the smart plug 20 may include such as, respectively, a nameplate 212 and indicator light 214, each of which the face 220 may include. In each of FIGS. 1 and 2, a cover 210 is shown secured to the smart plug 20 such that the nameplate 212 and indicator light 214 are so exposed, and may be at least partially to fully exposed as desired. In various embodiments, each cover 210 may be secured to the smart plug 20 as desired, such as by a snap fit arrangement, screw or other fastener, or otherwise as desired.

Each cover 210 may include at least one different feature (in comparison to at least one other cover 210), such as a different shape, texture, color, or other difference. A particular cover 210 may be selected to be secured over a certain smart plug 20 to create a different appearance, such as for purposes of décor, such as to match the interior of a building or home, or to differentiate different smart plugs 20 such as for purposes of identification. A cover 210 may also serve as a protective covering for the smart plug 20. If a cover 210 is damaged or marked, the cover 210 may be replaced.

Another embodiment of the smart plug system may include: a smart plug 20 comprising an aperture 50; and an anti-theft device 100 that is separate from and detachable from the smart plug, the anti-theft device 100 comprising: a body 110 securable to an electrical outlet 200; a protrusion 130 to extend into the aperture 50 of the smart plug; and a fastener 140 to secure the body 110 to the electrical outlet 200 by extending through the body 110 and into the electrical outlet 200, thereby securing the anti-theft device 100 to both the smart plug 20 and the electrical outlet 200 when the smart plug 20 is plugged into the electrical outlet 200.

In any of the embodiments described herein of a smart plug system or method, the fastener (e.g., 140, 340, 440, 442) may be, if desired, a tamper-resistant fastener that cannot be removed using a standard tool, or creates difficulty in being removed using a standard tool. The tamper-resistant fastener may be, for example, a breakaway head screw (in embodiments not including the tether 350, and thus fastener 340), one-way screw, pin-head screw, protruding obstacle screw, or other screw or fastener with a non-standard head or other non-standard feature that prevents, or makes difficult, removal of that fastener unless a specialized screwdriver or other specialized tool is used. An anti-theft device described herein (e.g., 100, 300, or 400) that uses a fastener that is tamper-resistant may provide further anti-theft protection for the smart plug 20.

The invention has been described with reference to the desirable embodiments. Modifications and alterations will occur to others upon reading and understanding the preceding detailed description. It is intended that the invention be construed as including all such modifications and alterations insofar as they come within the scope of the appended claims or the equivalents thereof.

Additionally, while certain aspects of conventional technologies have been discussed to facilitate disclosure of the invention, these technical aspects are in no way disclaimed, and it is contemplated that the claimed invention may encompass one or more of the conventional technical aspects discussed herein.

What is claimed is:

1. A smart plug system, comprising:

a smart plug; and an anti-theft device comprising a body and a fastener, the body to secure the smart plug to the electrical outlet by way of the fastener when the smart plug is plugged into the electrical outlet, the anti-theft device separate from and detachable from the smart plug, the smart plug comprising an aperture, the body of the anti-theft device comprising a hole, the anti-theft device further comprising a protrusion extending from the body, the protrusion to extend at least partially into the aperture of the smart plug; and wherein the fastener is to extend through the hole of the anti-theft device body and into the electrical outlet to said secure the smart plug to the electrical outlet when the smart plug is plugged into the electrical outlet, wherein said security of the smart plug to the electrical outlet is further, at least in part, by way of the protrusion said extending at least partially into the aperture of the smart plug to block removal of the smart plug from the electrical outlet.

2. The smart plug system of claim 1, the smart plug further comprising a face and a side adjacent to the face, the face comprising a plug receptacle, the aperture in the side.

3. The smart plug system of claim 1, the extension of the protrusion at least partially into the aperture of the smart plug being an adjustable extension.

4. The smart plug system of claim 3, the fastener to extend into the electrical outlet by way of an electrical outlet hole, the extension of the protrusion into the aperture of the smart plug an adjustable extension to align the hole of the body of the anti-theft device with the electrical outlet hole.

5. The smart plug system of claim 1, the smart plug further comprising a plug receptacle, the anti-theft device further comprising a clamp, the clamp comprising:

a hole and a securing structure, wherein the fastener is further to extend through the clamp hole, the securing structure to be secured to at least one of a plug and a cord of an apparatus to restrict removal of the apparatus plug from the smart plug.

6. A smart plug system, comprising:

a smart plug; and an anti-theft device comprising a body and a fastener, the body to secure the smart plug to the electrical outlet by way of the fastener when the smart plug is plugged into the electrical outlet;

the smart plug comprising a face; and the smart plug system further comprising a plurality of replaceable covers for the smart plug, each cover comprising at least one different feature, each cover securable onto the face of the smart plug; wherein the face of the smart plug comprises a plug receptacle; and each of the plurality of covers further comprises a receptacle hole, each cover securable onto the face of the smart plug such that the receptacle hole aligns with the plug receptacle of the smart plug thereby exposing at least a portion of the plug receptacle; wherein:

the face of the smart plug further comprises an indicator light and a nameplate; and each of the plurality of covers further comprises an indicator light hole and a nameplate hole, each cover securable onto the face of the smart plug such that:

the indicator light hole aligns with the indicator light of the smart plug thereby exposing at least a portion of the indicator light; and the nameplate hole aligns with the nameplate of the smart plug thereby exposing at least a portion of the nameplate.

* * * * *